US010605251B2

(12) United States Patent
Oh et al.

(10) Patent No.: US 10,605,251 B2
(45) Date of Patent: Mar. 31, 2020

(54) TURBO COMPRESSOR

(71) Applicant: LG ELECTRONICS INC., Seoul (KR)

(72) Inventors: Junchul Oh, Seoul (KR); Byeongchul Lee, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 15/864,082

(22) Filed: Jan. 8, 2018

(65) Prior Publication Data

US 2018/0195520 A1 Jul. 12, 2018

(30) Foreign Application Priority Data

Jan. 11, 2017 (KR) ..... 10-2017-0004347

(51) Int. Cl.
*F04D 17/12* (2006.01)
*F04D 27/00* (2006.01)
(Continued)

(52) U.S. Cl.
CPC ..... *F04D 27/002* (2013.01); *F04D 17/122* (2013.01); *F04D 29/041* (2013.01);
(Continued)

(58) Field of Classification Search
CPC .. F04D 17/122; F04D 29/041; F04D 29/0416; F04D 29/051; F04D 29/0516; F04D 29/286; F05D 2260/15
See application file for complete search history.

(56) References Cited

U.S. PATENT DOCUMENTS 971,851 A * 10/1910 Krogh ..... F04D 15/0027 415/14
976,400 A * 11/1910 Salzer ..... F04D 29/2266 415/106
(Continued)

FOREIGN PATENT DOCUMENTS

EP 0 252 045 1/1988
JP 62-294701 12/1987

OTHER PUBLICATIONS

International Search Report dated Apr. 17, 2018.
European Search Report dated May 25, 2018.

*Primary Examiner* — Ninh H. Nguyen
(74) *Attorney, Agent, or Firm* — Ked & Associates LLP

(57) ABSTRACT

A turbo compressor is provided that may include an impeller housing having an impeller accommodation space, an inlet formed at a first side of the impeller accommodation space, and an outlet formed at a second side of the impeller accommodation space that communicates with the inlet; an impeller accommodated in the impeller accommodation space of the impeller housing, rotated together with a rotary shaft by being coupled to the rotary shaft, and configured to centrifugally-compress a fluid suctioned through the inlet of the impeller housing and discharge the compressed fluid outside of the impeller housing through the outlet; a back pressure space formed between a rear surface of the impeller and the impeller housing; a back pressure passage connected between the outlet of the impeller housing and the back pressure space; and a back pressure control valve installed between the back pressure passage and the back pressure space, and configured to selectively open and close a region therebetween.

18 Claims, 9 Drawing Sheets

(51) Int. Cl.

| | |
|---|---|
| ***F04D 29/041*** | (2006.01) |
| ***F04D 29/051*** | (2006.01) |
| *F04D 29/28* | (2006.01) |
| *F04D 29/053* | (2006.01) |
| *F04D 29/42* | (2006.01) |
| *F04D 29/58* | (2006.01) |
| *F04D 25/06* | (2006.01) |

(52) U.S. Cl.

CPC ..... *F04D 29/0416* (2013.01); *F04D 29/051* (2013.01); *F04D 29/0513* (2013.01); *F04D 29/0516* (2013.01); *F04D 25/06* (2013.01); *F04D 29/053* (2013.01); *F04D 29/286* (2013.01); *F04D 29/4206* (2013.01); *F04D 29/5806* (2013.01); *F05D 2260/15* (2013.01)

(56) References Cited

U.S. PATENT DOCUMENTS

| | | | | | |
|---|---|---|---|---|---|
| 2,888,193 | A * | 5/1959 | Greenwald | F04D 25/0606 | 417/370 |
| 4,472,107 | A * | 9/1984 | Chang | F01D 3/04 | 415/104 |
| 4,493,610 | A | 1/1985 | Iino et al. | | |
| 5,358,378 | A | 10/1994 | Holscher | | |
| 5,980,114 | A * | 11/1999 | Oklejas, Jr. | F04D 29/047 | 384/123 |
| 8,016,545 | B2 * | 9/2011 | Oklejas, Jr. | F04D 29/0416 | 415/106 |
| 8,113,798 | B2 * | 2/2012 | Bosen | F01D 3/04 | 384/306 |
| 2003/0026714 | A1 | 2/2003 | Bosen | | |
| 2005/0142003 | A1 | 6/2005 | Hembree et al. | | |
| 2010/0329845 | A1 | 12/2010 | Kim et al. | | |

* cited by examiner

TURBO COMPRESSOR

CROSS-REFERENCE TO RELATED APPLICATION(S)

Pursuant to 35 U.S.C. § 119(a), this application claims the benefit of an earlier filing date of and the right of priority to Korean Application No. 10-2017-0004347, filed in Korea on Jan. 11, 2017, the contents of which are incorporated by reference herein in its entirety.

BACKGROUND

1. Field

A turbo compressor capable of centrifugally-compressing a refrigerant by rotating an impeller is disclosed herein.

2. Background

Generally, a compressor may be largely categorized into a positive displacement compressor and a turbo compressor. The positive displacement compressor is configured to suction, compress, and discharge a fluid using a piston or a vane, similar to a reciprocating type or a rotational type. On the other hand, the turbo compressor is configured to suction, compress, and discharge a fluid using a rotational element.

The positive displacement compressor determines a compression ratio by properly controlling a ratio of a suction volume and a discharge volume, in order to obtain a desired discharge pressure. Thus, there is a limitation in minimizing an entire size of the positive displacement compressor in comparison with a capacity.

The turbo compressor is similar to a turbo blower, but has a higher discharge pressure and a smaller flow amount than the turbo blower. Such a turbo compressor is configured to increase a pressure of a fluid which flows consecutively. If the fluid flows in an axial direction, the turbo compressor may be categorized as an axial compressor. On the contrary, if the fluid flows in a radial direction, the turbo compressor may be categorized as a centrifugal compressor.

Unlike a positive displacement compressor, such as a reciprocating compressor or a rotary compressor, the turbo compressor has a difficulty in obtaining a desired high pressure ratio by a single compression, due to processability, a massive productivity, and durability, for example, even if a rotating blade of an impeller is designed to have an optimum shape. Accordingly, there has been provided a multi-stage type turbo compressor for compressing a fluid in multi stages by having a plurality of impellers in an axial direction.

Such a conventional art multi-stage turbo compressor is shown in FIG. 1 and is configured to sequentially compress a fluid as a first impeller 1 and a second impeller 2 face each other at two ends of a rotary shaft 4 with a rotor 3 interposed therebetween. Alternatively, the multi-stage turbo compressor is configured to compress a fluid by multi stages, as the first impeller 1 and the second impeller 2 are sequentially installed at the rotary shaft 4 at one side of the rotor 3, as shown in FIG. 2.

However, if the first impeller 1 and the second impeller 2 are installed at two sides of the rotor 3 in a facing manner, a thrust direction of the first impeller 1 is opposite to a thrust direction of the second impeller 2. This may restrict a movement in an axial direction to some degree, and reduce a size of a thrust bearing. However, in case of such a facing type, a complicated and long pipe or fluid passage is required to connect the plurality of impellers 1, 2 to each other. This may cause the turbo compressor to have a complicated structure. Further, as a fluid compressed in the first impeller 1 moves to the second impeller 2 through the long fluid passage, a compression loss may occur, resulting in lowering a compression efficiency.

On the other hand, if the first impeller 1 and the second impeller 2 are sequentially installed at the rotary shaft 4 at one side of the rotor 3, a pipe or fluid passage for connecting the plurality of impellers 1, 2 to each other is formed to be short, resulting in preventing a lowering of a compression efficiency. However, in a case of such a sequential type, a thrust direction of the first impeller 1 is the same as a thrust direction of the second impeller 2. This may increase a movement in an axial direction, and increase a size of a thrust bearing 5, resulting in increasing an entire size of the compressor. Further, as a load applied to a drive unit when the compressor is operated at a high speed is increased, the drive unit may be overheated.

Especially, in a case of such a sequential type, when the compressor is operated at a high speed and a high pressure ratio, a high pressure fluid compressed in a single stage at the first impeller 1 is introduced into the second impeller 2. As a result, the second impeller 2 receives a high pressure in a backward direction. This may cause the first and second impellers 1, 2 to be pushed backward, and to be damaged by colliding with members facing rear surfaces of the first and second impellers 1, 2. Further, since rotary elements including the plurality of impellers 1, 2 have an unstable behavior, the compressor may have a lowered reliability.

BRIEF DESCRIPTION OF THE DRAWINGS

Embodiments will be described in detail with reference to the following drawings in which like reference numerals refer to like elements, and wherein.

DETAILED DESCRIPTION

Figure 1:
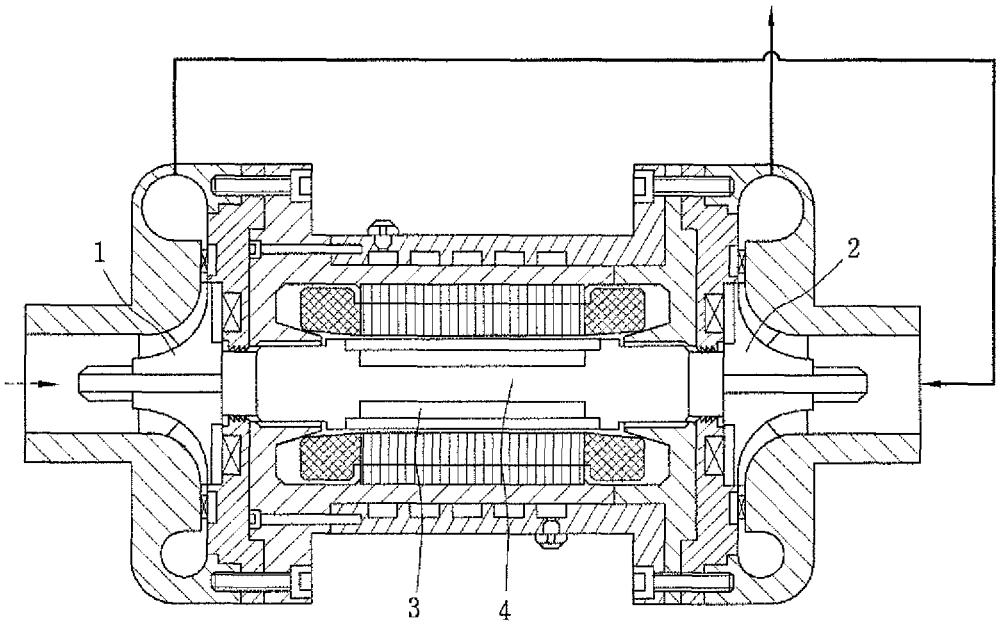
FIG. 1 CONVENTIONAL ART
FIGS. 1 and 2 are sectional views of turbo compressors in accordance with the conventional art.
Figure 2:
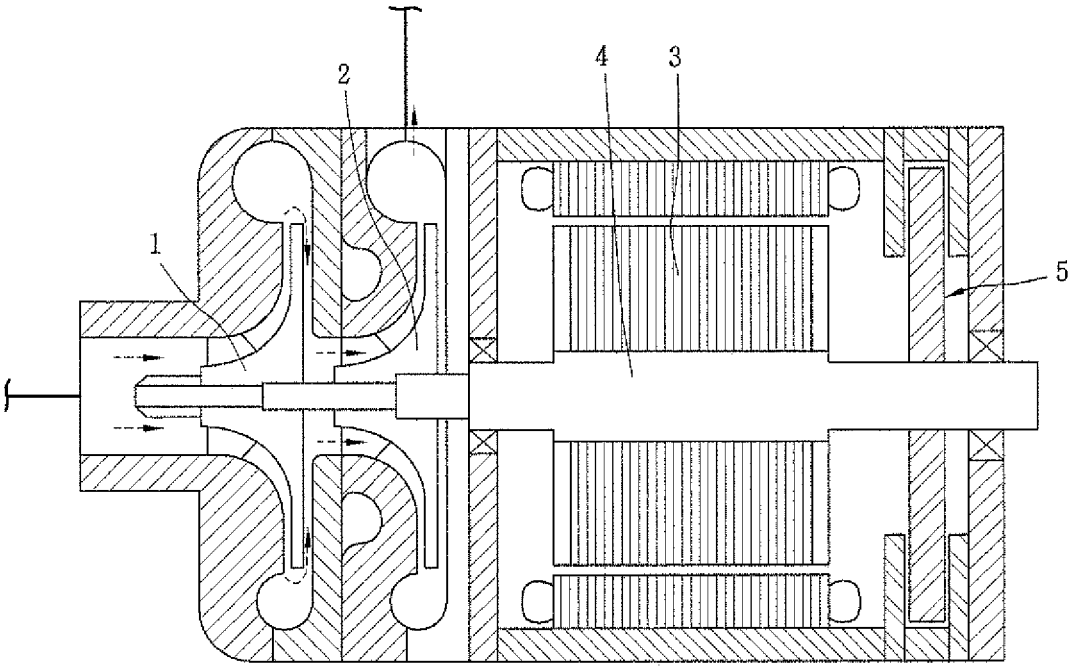
FIG. 2 CONVENTIONAL ART

Hereinafter, a turbo compressor according to embodiments will be explained with reference to the attached drawings. Where possible, like reference numerals have been used to indicate like elements, and repetitive disclosure has been omitted.

Figure 3:
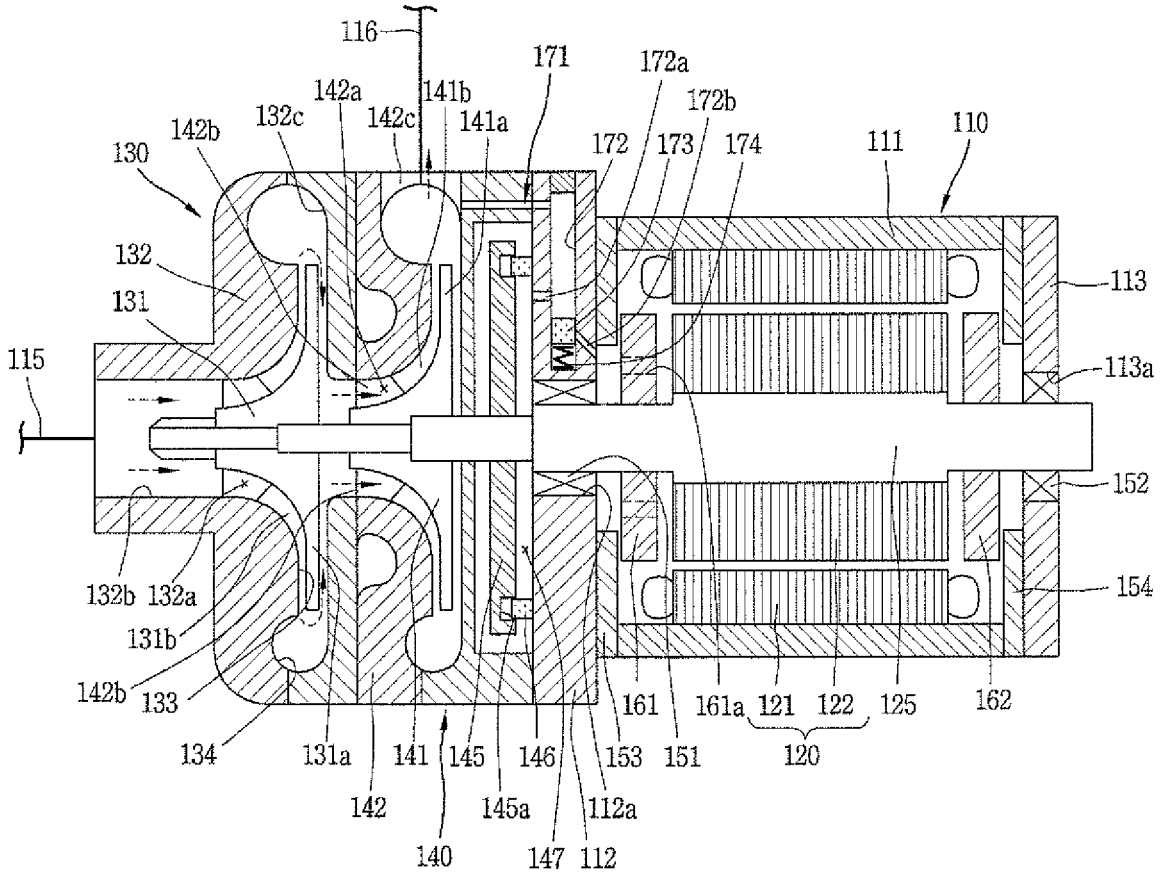
FIG. 3 is a cross-sectional view of a turbo compressor according to an embodiment.
Figure 4:
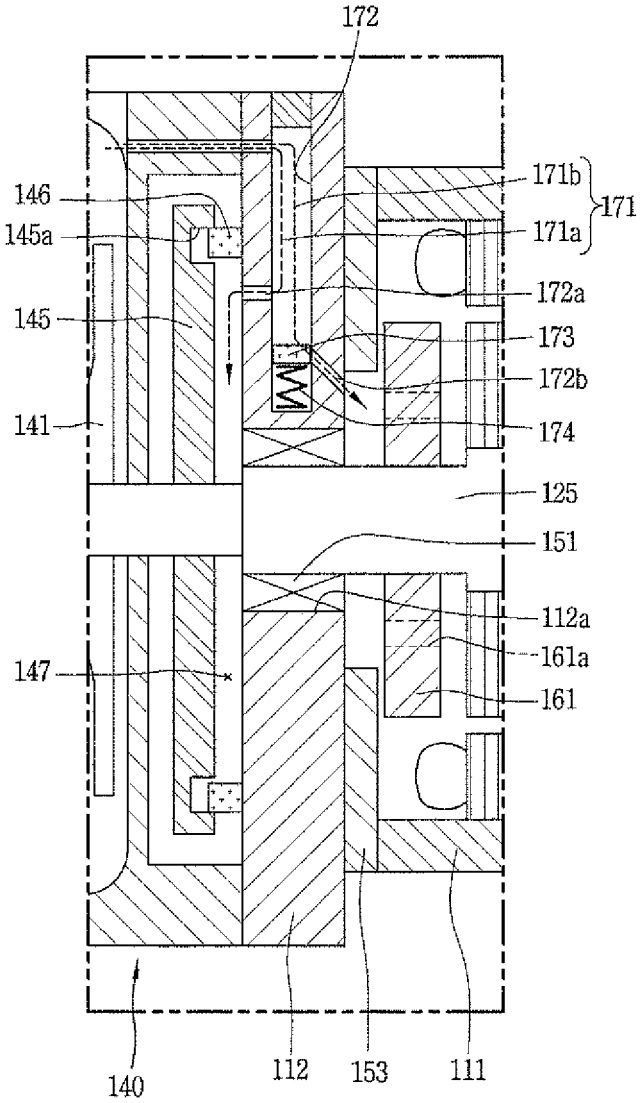
FIG. 4 is a cross-sectional view of a back pressure portion of the turbo compressor of FIG. 3.
Figure 5:
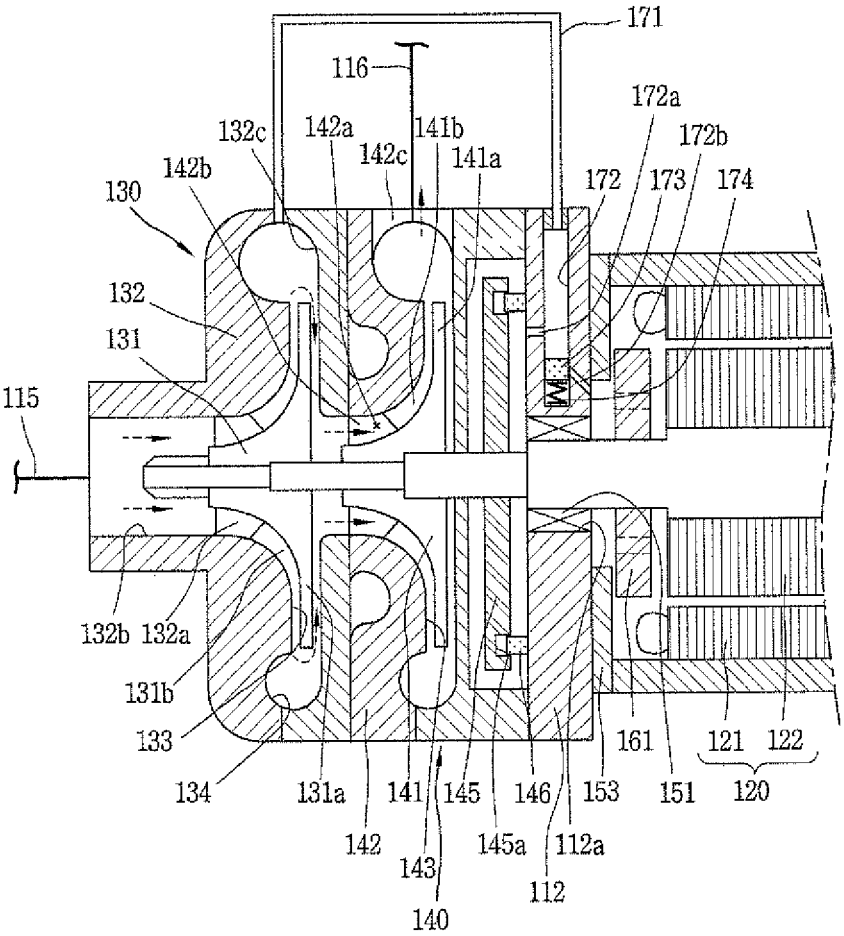
FIG. 5 is a cross-sectional view of a back pressure passage of the turbo compressor shown in FIG. 3 according to another embodiment.

FIG. 3 is a cross-sectional view of a turbo compressor according to an embodiment. FIG. 4 is a cross-sectional view showing a back pressure portion of the turbo compressor of FIG. 3. FIG. 5 is a cross-sectional view of a back pressure passage of the turbo compressor shown in FIG. 3 according to another embodiment.

Referring to FIG. 3, in the turbo compressor according to this embodiment, a drive unit or drive 120 may be installed at an inner space of a casing 110, and a first compression unit 130 and a second compression unit 140 may be installed outside of casing 110. The drive unit 120 may be connected to the compression units 130, 140 by a rotary shaft 125. The casing 110 may include a shell 111 formed to have a cylindrical shape and having its two ends open, and a front frame 112 and a rear frame 113 that cover the two open ends of the shell 111.

A stator 121 of the drive unit 120, which is discussed hereinafter, may be fixedly-coupled to an inner circumferential surface of the shell 111, and shaft holes 112*a*, 113*a* that pass therethrough the rotary shaft 125, which is discussed hereinafter may be formed at middle regions of the front and rear frames 112, 113. Radial bearings 151, 152 that support the rotary shaft 125 in a radial direction may be installed at the shaft holes 112*a*, 113*a* of the front and rear frames 112, 113, respectively.

A first thrust bearing 153 may be coupled to an inner side surface of the front frame 112, and a second thrust bearing 154 may be coupled to an inner side surface of the rear frame 113. First and second axial supporting plates 161, 162 may be fixedly-coupled to the rotary shaft 125, which is discussed hereinafter, so as to face the first and second thrust bearings 153, 154, respectively. That is, the first thrust bearing 153 forms a first direction thrust restricting portion together with the first axial supporting plates 161, and the second thrust bearing 154 forms a second direction thrust restricting portion together with the second axial supporting plates 162. With such a configuration, the first direction thrust restricting portion and the second direction thrust restricting portion form thrust bearings in opposite directions, thereby attenuating a thrust with respect to rotary elements including the rotary shaft 125.

The drive unit 120 generates a drive force to compress a refrigerant. The drive unit 120 includes the stator 121 and a rotor 122, and the rotary shaft 125 that transmits a rotational force of the rotor 122 to first and second impellers 131, 141, which is discussed hereinafter, is coupled to a center of the rotor 122.

The stator 121 may be forcibly-fixed to an inner circumferential surface of the casing 110, or may be fixed to the casing 110 by, for example, welding. As the stator 121 has an outer circumferential surface cut in a D-shape, a passage along which a fluid moves may be formed between the outer circumferential surface of the stator 121 and an inner circumferential surface of the casing 110.

The rotor 122 is positioned in the stator 121, and is spaced apart from the stator 121. Balance weights that attenuate eccentric loads generated by the first and second impellers 131, 141 may be coupled to both ends of the rotor 122 in an axial direction. However, the balance weights may be coupled to the rotary shaft 125 without being installed at the rotor 122. In a case of coupling the balance weights to the rotary shaft 125, the aforementioned first and second axial supporting plates 161,162 may be used as the balance weights.

The rotary shaft 125 may be forcibly-coupled by passing through the center of the rotor 122. Thus, the rotary shaft 125 may be rotated together with the rotor 122 by receiving a rotational force generated by a reciprocal operation of the stator 121 and the rotor 122. The rotational force may be transmitted to the first and second impellers 131, 141, thereby suctioning, compressing, and discharging a refrigerant.

The first and second axial supporting plates 161,162, supported in the axial direction by the first and second thrust bearings 153, 154 provided at the casing 110, may be fixedly-coupled to both sides of the rotary shaft 125, that is, two sides of the rotor 122. Accordingly, as aforementioned, the rotary shaft 125 may effectively attenuate thrusts generated by the first and second compression units 130, 140, as the first and second axial supporting plates 161,162 provided at the rotary shaft 125 are supported in opposite directions by the first and second thrust bearings 153, 154 provided at the casing 110.

The first and second axial supporting plates 161,162 may be integrally provided at both ends of the rotor 122. In this case, frictional heat generated when the first and second axial supporting plates 161,162 support the rotary shaft 125 in the axial direction may be transferred to the rotor 122. Further, if the first and second axial supporting plates 161,162 are transformed by receiving a load in the axial direction, the rotor 122 may be transformed. Thus, the first and second axial supporting plates 161,162 may be spaced apart from both ends of the rotor 122.

In a case of fixedly-coupling the first and second axial supporting plates 161,162 to the rotary shaft 125, as aforementioned, the first and second axial supporting plates 161,162 may be used as balance weights by having their weight and fixed position controlled. In this case, as additional balance weights are not installed at the rotor 122, a weight of the rotary elements may be reduced. Further, as a length of the turbo compressor in the axial direction is reduced, the turbo compressor may be minimized. The first and second thrust bearings 153, 154 may not be installed at the front and rear frames 112, 113, but may be installed at opposite side, that is, at the first and second axial supporting plates 161,162.

A front fixing plate (not shown) and a rear fixing plate (not shown) fixed to the casing 110 may be further provided in the casing 110, that is, between the front frame 112 and the rotor 122, or between the rear frame 113 and the rotor 122. The first and second thrust bearings 153, 154 may be installed at the front and rear fixing plates, respectively. In this case, a length of the turbo compressor in the axial direction may be increased, and a number of processes may be increased. However, a reliability may be higher than when thrust bearings are directly installed at the casing 10. Although not shown, the first and second thrust bearings 153, 154 may be installed in an assembled manner, at one side of the drive unit 120, that is, a front side or a rear side of the stator 121.

The compression unit may be implemented as a single compression unit for performing a single compression. Alternatively, as shown in this embodiment, the compression unit may be implemented as a plurality of compression units for performing a multi-stage compression. In a case of a multi-stage compression, the plurality of compression units 130, 140 may be installed at both sides of the casing 110 on the basis of the drive unit 120, for enhanced reliability when considering a characteristic of the turbo compressor having a large load in the axial direction. However, in a case of a facing type turbo compressor where a plurality of compression units is installed at two sides, as aforementioned, the turbo compressor may have a great length and a lowered compression efficiency. Accordingly, for high efficiency and a small size, the plurality of compression units 130, 140 may be installed at one side of the casing 110 on the basis of the drive unit 120. Hereinafter, the plurality of compression units for compressing a refrigerant in multi stages will be explained as first and second compression units according to a refrigerant compression order.

The first and second compression units 130, 140 may be consecutively installed at one side of the casing 110, in the axial direction. The first and second compression units 130, 140 may be coupled to the rotary shaft 125 as impellers 131, 141 thereof may be accommodated in impeller housings 132, 142, respectively. That is, the first compression unit 130 may be coupled to the rotary shaft 125 as the first impeller 131 is accommodated in the first impeller housing 132. The second compression unit 140 may be coupled to the rotary shaft 125 as the second impeller 141 is accommodated in the second impeller housing 142. However, in some cases, the first and second compression units 130, 140 may be coupled to the rotary shaft 125 as the impellers 131, 141 thereof are consecutively arranged at or in a single impeller housing. However, in this case, as the plurality of impellers should be installed at or in one impeller housing, the impeller housing may have a very complicated shape.

In this embodiment, a multi-stage turbo compressor where a plurality of impellers is consecutively installed at one side in the axial direction on the basis of the drive unit (or the casing) will be explained as an example. However, embodiments may be also applicable to a single turbo compressor having a single impeller, or a multi-stage turbo compressor where a plurality of impellers is installed at both ends of a rotary shaft so as to consecutively compress a refrigerant.

A first impeller accommodation space 132*a* that accommodates the first impeller 131 therein may be formed in the first impeller housing 132. A first inlet 132*b*, connected to a suction pipe 115 and through which a refrigerant may be suctioned from an evaporator of a refrigerating cycle, may be formed at one or a first end of the first impeller housing 132. A first outlet 132*c*, through which a refrigerant compressed in a single stage may be guided to the second impeller housing 142 which is discussed hereinafter, may be formed at another or a second end of the first impeller housing 132.

The first impeller accommodation space 132*a* may have a hermetic shape except for the first inlet 132*b* and the first outlet 132*c*, so as to completely accommodate the first impeller 131 therein. However, the first impeller accommodation space 132*a* may have a semi-hermetic shape where a rear surface of the first impeller 131 is open and the open surface is closed by a front side surface of the second impeller housing 142, which is discussed hereinafter.

A first diffuser 133 may be formed between the first inlet 132*b* and the first outlet 132*c*, in a spaced manner from an outer circumferential surface of a blade portion or blade 131*b* of the first impeller 131 by a predetermined distance. A first volute 134 may be formed at a wake flow side of the first diffuser 133. The first inlet 132*b* may be formed at a center of one end of the first diffuser 133 in the axial direction, and the first outlet 132*c* may be formed at a wake flow side of the first volute 134.

The first impeller 131 may include a first disc portion or disc 131*a* coupled to the rotary shaft 125, and a plurality of first blade portions or blade 131*b* formed at a front surface of the first disc portion 131*a*. The front surface of the first disc portion 131*a* may be formed to have a conical shape by the plurality of first blade portions 131*b*, but a rear surface thereof may be formed to have a plate shape so as to receive a back pressure.

A first back pressure plate (not shown) coupled to the rotary shaft 125 may be provided at a rear side of the first disc portion 131*a*, in a spaced manner by a predetermined distance. A first sealing member or seal (not shown) having a ring shape may be provided at the first back pressure plate. With such a configuration, a first back pressure space (not shown) where a predetermined refrigerant is filled may be formed at the rear side of the first disc portion 131*b*, between a front surface of the second impeller housing, which is discussed hereinafter, and the first back pressure plate. However, as a refrigerant suctioned through the first inlet 132*b* does not have a high pressure, a thrust with respect to the rotary shaft 125 may not be large. Thus, the first back pressure space may not be formed.

A second impeller accommodation space 142*a* that accommodates the second impeller 141 therein may be formed in the second impeller housing 142. A second inlet 142*b*, connected to the first outlet 132*c* of the first impeller housing 132 and through which a refrigerant compressed in a single stage may be suctioned, may be formed at one or b first end of the second impeller housing 142. A second outlet 142*c*, connected to a discharge pipe 116 and through which a refrigerant compressed in two stages may be guided to a condenser of the refrigerating cycle, may be formed at another or a second end of the second impeller housing 142.

A second diffuser 143 may be formed between the second inlet 142*b* and the second outlet 142*c*, in a spaced manner from an outer circumferential surface of a blade portion or blade 141*b* of the second impeller 141 by a predetermined distance. A second volute 144 may be formed at a wake flow side of the second diffuser 143. The second inlet 142*b* may be formed at a center of one end of the second diffuser 143 in the axial direction, and the second outlet 142*c* may be formed at a wake flow side of the second volute 144.

The second impeller 141 may include a second disc portion or disc 141*a* coupled to the rotary shaft 125, and a plurality of second blade portions or blades 141*b* formed at a front surface of the second disc portion 141*a*. The front surface of the second disc portion 141*a* may be formed to have a conical shape by the plurality of second blade portions 141*b*, but a rear surface thereof may be formed to have a plate shape so as to receive a back pressure.

A second back pressure plate 145 coupled to the rotary shaft 125 may be provided at a rear side of the second disc portion 141*a*, in a spaced manner by a predetermined distance. A second sealing groove 145*a* having a ring shape may be formed at the second back pressure plate 145, thereby inserting a second sealing member or seal 146 therein. With such a configuration, a second back pressure space 147 where a predetermined refrigerant is filled may be formed at a rear side of the second disc portion 141*a*, between a front surface of the casing 110 and the second back pressure plate 145. As a refrigerant introduced into the second back pressure space 147 is partially introduced into the second sealing groove 145*a* to lift the second sealing member 146, the second sealing member 146 may be adhered to a front surface of the front frame 112 to thus seal the second back pressure space 147.

A back pressure passage 171, which is discussed hereinafter, may be connected to the second back pressure space 147. A back pressure control valve 173 that selectively opens and closes the back pressure passage 171 may be installed at the back pressure passage 171, such that a pressure of the second back pressure space 147 may be variable according to a drive speed (that is, a compression ratio) of the turbo compressor.

For example, as shown in FIG. 4, the back pressure passage 171 may be penetratingly-formed at the second impeller housing 142 and the casing 110. That is, a first back pressure passage 171*a* may be formed between an outlet of the second impeller housing 142 and the second back pressure space 147, and a second back pressure passage 171*b* may be formed between an outlet of the second impeller housing 142 and the inner space of the casing 110. Accordingly. The first back pressure passage 171*a* and the second back pressure passage 171*b* may be selectively communicated with the outlet of the second impeller housing 142 by the back pressure valve 173. The back pressure passage 171 may be formed as a pipe diverged from a middle region of the discharge pipe. However, the back pressure passage 171 may be formed in the impeller housing and the front frame, for low fabrication costs due to a reduced number of components. However, in some cases, the back pressure passage 171 may be formed by assembling an additional valve frame provided with the back pressure passage, to a front surface of the casing.

A valve space 172 having a predetermined depth in a radial direction may be formed at the front frame 112 of the casing 110, and the back pressure control valve 173 that selectively opens and closes first and second back pressure holes 172*a*, 172*b*, which are discussed hereinafter, by sliding in the valve space 172 may be inserted into the valve space 172. A valve spring 174 that elastically supports the back pressure control valve 173 may be installed between the valve space 172 and the back pressure control valve 173.

The valve space 172 may be concaved from an outer circumferential surface of the front frame 112 of the casing 110 towards an inner circumferential surface thereof, by a predetermined depth. A first back pressure hole 172*a* that communicates the valve space 172 with the second back pressure space 147 may be formed at a middle region of the valve space 172. The first back pressure hole 172*a* may be formed to have an inner diameter smaller than or equal to an inner diameter of the valve space 172. Accordingly, the valve space 172 and the first back pressure hole 172*a* form the first back pressure passage 171*a*.

A second back pressure hole 172*b* that communicates the valve space 172 with the inner space of the casing 110 may be formed at one or a first side of the first back pressure hole 172*a*. The second back pressure hole 172*b* may be formed at an inner side than the first back pressure hole 172*a*, so as to be open when receiving a higher pressure than the first back pressure hole 172*a* in a case in which the back pressure control valve 173 is open by pressure. Alternatively, the second back pressure hole 172*b* may be formed at a same position as the first back pressure hole 172*a*, that is, at a position where the first back pressure hole 172*a* and the second back pressure hole 172*b* are simultaneously opened and closed. Alternatively, the second back pressure hole 172*b* may be formed at an outer side than the first back pressure hole 172*a*. Accordingly, the valve space 172 and the second back pressure hole 172*b* form the second back pressure passage 171*b*.

The back pressure control valve 173 may be formed as a ball valve or a piston valve, for example. The back pressure control valve 173 may have three positions according to a difference in a force by a pressure of a refrigerant introduced through the back pressure passage 171, and a force by an elastic force of an elastic member. That is, the back pressure control valve 173 may be formed to have a first position where both of the first back pressure hole 172*a* and the second back pressure hole 172*b* are closed, a second position where the first back pressure hole 172*a* is open but the second back pressure hole 172*b* is closed, and a third position where both of the first back pressure hole 172*a* and the second back pressure hole 172*b* are open.

For this, the valve spring 174 may be formed as a compressive coil spring, and may be installed between an inner surface of the back pressure control valve 173 and the valve space 172. Alternatively, the valve spring 174 may be formed as a tension spring, and may be installed between an outer surface of the back pressure control valve 173 and the valve space 172.

In the aforementioned embodiment, the first back pressure passage 171*a* may be connected to a discharge side of the second compression unit 140, that is, the second outlet 142*c*. However, in some cases, as shown in FIG. 5, the back pressure passage 171 may be connected to a discharge side of the first compression unit 130. In this case, the basic configuration such as the valve space 172 and the back pressure control valve 173 may be the same as that of the previous embodiment.

The turbo compressor according to this embodiment may be operated as follows.

That is, if power is supplied to the drive unit 120, a rotational force may be generated by an induced current between the stator 121 and the rotor 122. The rotary shaft 125 may be rotated together with the rotor 122 by the generated rotational force. Then, the rotational force of the drive unit 120 may be transferred to the first and second impellers 131, 141 by the rotary shaft 125, and the first and second impellers 131, 141 may be simultaneously rotated in the first and second impeller accommodation spaces 132*a*, 142*a*, respectively.

A refrigerant having passed through an evaporator of a refrigerating cycle may be introduced into the first impeller accommodation space 132*a* through the suction pipe and the first inlet 132*b*. The refrigerant has its static pressure increased while moving along the blade portion 131*b* of the first impeller 131, and passes through the first diffuser 133 with a centrifugal force.

A kinetic energy of the refrigerant passing through the first diffuser 133 has a pressure head increased by centrifugal force at the first diffuser 133. The centrifugally-compressed refrigerant of high temperature and high pressure may be collected at the first volute 134, and discharged out through the first outlet 132*c*.

The refrigerant discharged out through the first outlet 132*c* may be transferred to the second impeller 141 through the second inlet 142*b* of the second impeller housing 142, and has its static pressure increased again in the second impeller 141. The refrigerant may pass through the second diffuser 143 with a centrifugal force.

The refrigerant passing through the second diffuser 143 may have its pressure compressed to a desired level by centrifugal force. The two-stage compressed refrigerant of high temperature and high pressure may be collected at the second volute 144, and be discharged to a condenser through the second outlet 142*c* and the discharge pipe 116. Such a process may be repeatedly performed.

The first and second impellers 131, 141 receive a thrust by which they are pushed backward by a refrigerant suctioned through the first and second inlets 132*b*, 142*b* of the impeller housings 132, 142. Especially, in a case of the second impeller 141, the refrigerant compressed by the first impeller 131 by a single stage is introduced through the second inlet 141*b*, thereby receiving a relatively large thrust in the backward direction. Such a thrust in the backward direction is restricted by the first and second thrust bearings 153, 154 provided in the casing 110. As a result, the first and second impellers 131, 141 may be prevented from being pushed backward together with the rotary shaft 125.

However, as aforementioned, if the first and second impellers 131, 141 are installed at one side on the basis of the drive unit 120, a refrigerant has a large thrust backward in the axial direction. In this case, the turbo compressor may maintain its reliability when the thrust bearings have a large sectional area. However, this may cause the turbo compressor to have a large size, and may increase a frictional loss at the thrust bearings to lower a compressor efficiency. Further, when the turbo compressor is operated at a high speed, a load of the drive unit is increased. This may cause a heat generation amount to be increased. The increased heat generation amount may not be effectively cooled, or an additional cooling device may be required, resulting in increasing fabrication costs.

To solve this, in this embodiment, the back pressure space 147 is additionally formed on rear surfaces of the first and second impellers 131, 141, especially, on the rear surface of the second impeller 141. Then, if a high-pressure refrigerant compressed in a single stage or two stages is supplied to the back pressure space 147 to prevent the second impeller 141 from being pushed backward, a load applied to the thrust bearing may be reduced. This may reduce a size of the thrust bearings and may reduce a frictional loss by the thrust bearings, thereby enhancing a compression efficiency.

When the turbo compressor is operated at a high speed, an amount of heat generated from the drive unit 120 may be increased. However, if the drive unit 120 is cooled as refrigerant to be bypassed is partially introduced into the inner space of the casing 110, the drive unit 120 may have an enhanced performance and the turbo compressor may have an enhanced efficiency.

Figure 6:
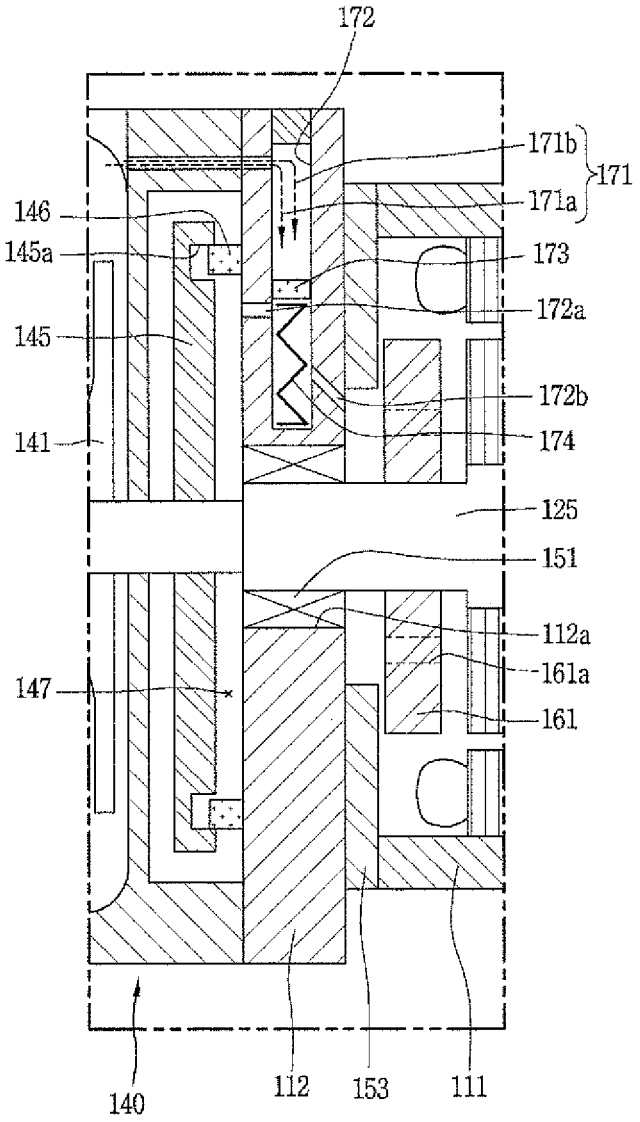
FIGS. 6 to 8 are cross-sectional views showing an operation state of a back pressure control valve according to a pressure of a refrigerant introduced into a valve space through the back pressure passage in the turbo compressor according to an embodiment.
Figure 7:
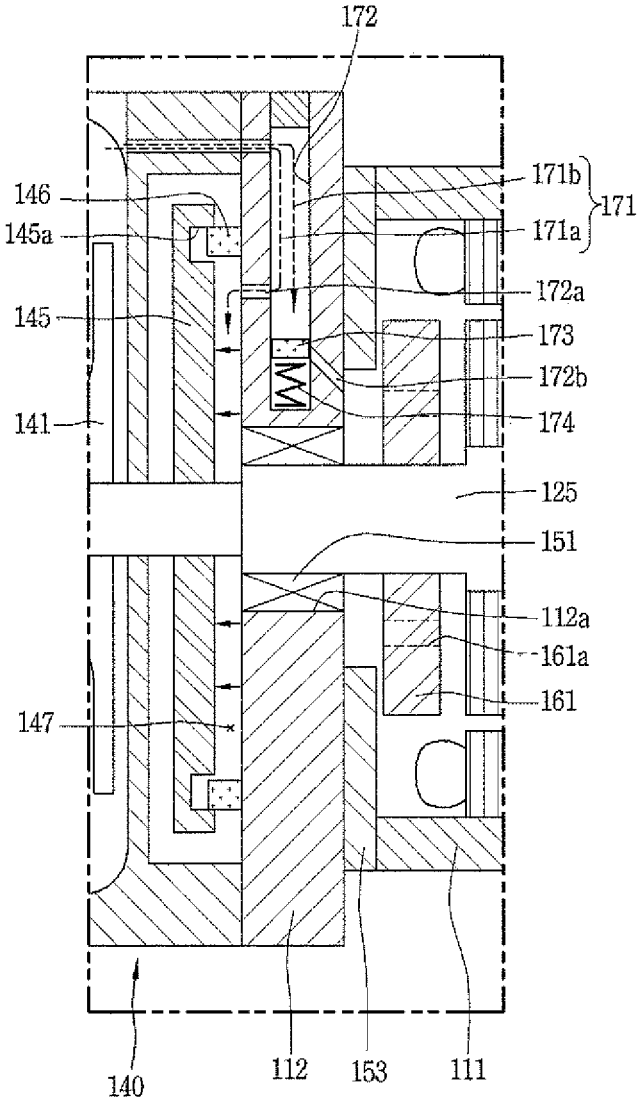
Figure 8:
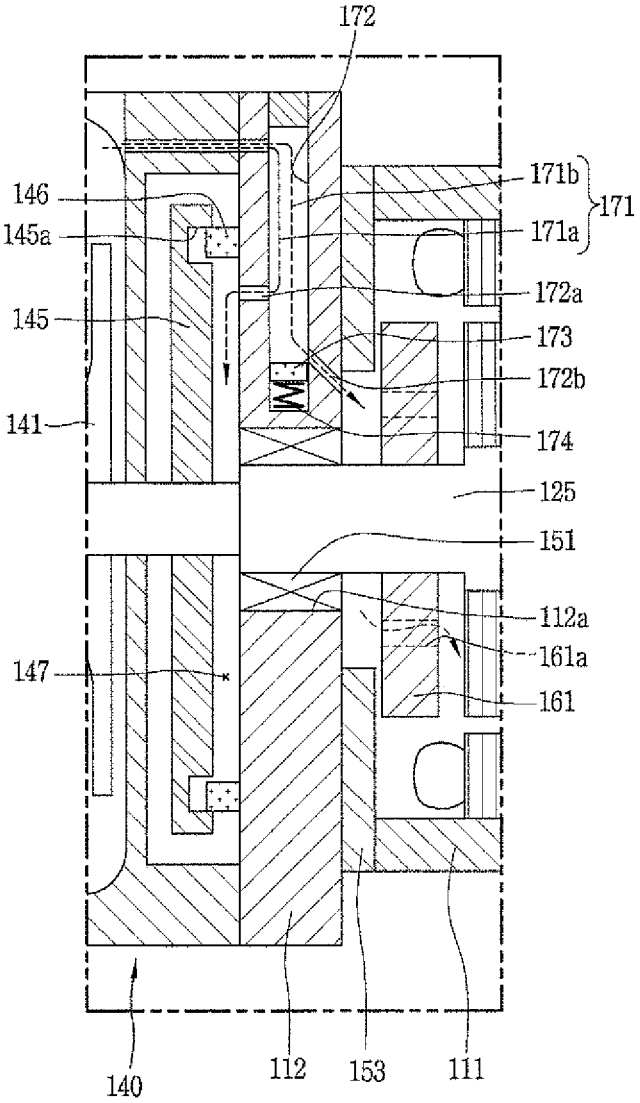

FIGS. 6 to 8 are cross-sectional views showing an operation state of the back pressure control valve according to a pressure of a refrigerant introduced into the valve space through the back pressure passage in the turbo compressor according to an embodiment. That is, a high-pressure refrigerant compressed in two stages by the second impeller 141 may be discharged to the discharge pipe 116 through the second outlet 142*c*. Before or after being discharged to the discharge pipe 116, the high-pressure refrigerant may be partially bypassed to the back pressure passage 171 to thus be introduced into the valve space 172. Then, the refrigerant introduced into the valve space 172 pushes the back pressure control valve 173 inward.

As shown in FIG. 6, if the drive unit 120 has a low rotational speed (first speed), a pressure ratio of the second compression unit 140 becomes lower than a reference pressure ratio (a pressure equal to an elastic force of the valve spring 174). As a result, a force by a pressure of the refrigerant compressed by the second impeller 141 becomes smaller than a force by the elastic force of the valve spring 174, and the back pressure control valve 173 maintains a first position (P1) by being pushed by the elastic force of the valve spring 174.

As a result, both of the first and second back pressure holes 172*a*, 172*b* are closed, and the rotary shaft 125 and the first and second impellers 131, 141 prevent a thrust in the axial direction only by the first and second thrust bearings 153, 154. However, in this case, as the rotational speed of the drive unit 120 is not high, the refrigerant suctioned to the inlets of the first and second impellers 131, 141 does not have a high pressure. Accordingly, even if the first and second thrust bearings 153, 154 have a small area, a thrust can be prevented sufficiently.

On the other hand, as shown in FIG. 7, if the rotational speed of the drive unit 120 is higher than the first speed, and if the force by the pressure of the refrigerant compressed by the second impeller 141 becomes a second speed larger than the force by the elastic force of the valve spring 174, the back pressure control valve 173 moves to a second position (P2). The reason is because a force obtained by adding a pressure (inner pressure) formed at the inner space of the casing 110 to the elastic force of the valve spring 174 becomes higher than the pressure by the second impeller 141.

Then, the first back pressure hole 172*a* is opened and the second back pressure hole 172*b* is closed, and the high-pressure refrigerant bypassed to the back pressure passage 171 moves only to the back pressure space 147 through the first back pressure hole 172*a*. The back pressure space 147 has a high pressure by the refrigerant introduced thereinto, thereby supporting the second back pressure plate 145 and preventing the second impeller 141 from being pushed backward in the axial direction. In this case, the back pressure of the back pressure space 147 prevents the rotary shaft 125 and the second impeller 141 from being pushed backward, together with the first and second thrust bearings 153, 154. As a result, even if the first and second thrust bearings 153, 154 have a small area, the rotary shaft 125 and the second impeller 141 may be supported stably.

On the other hand, as shown in FIG. 8, if the rotational speed of the drive unit 120 is a third speed higher than the second speed, the force by the pressure of the refrigerant compressed by the second impeller 141 becomes greater than the force obtained by adding the inner pressure of the casing 110 to the elastic force of the valve spring 174. As a result, as the back pressure control valve 173 is pushed to a third position (P3) by the refrigerant introduced into the valve space 172 through the back pressure passage, both of the first and second back pressure holes 172*a*, 172*b* are opened.

As the high-pressure refrigerant moves to the back pressure space 147 to increase the pressure of the back pressure space 147, a back surface of the second impeller 141 is supported forward. As a result, even if the first and second thrust bearings 153, 154 have a small area, the rotary shaft 125 and the first and second impellers 131, 141 may be effectively prevented from being pushed backward in the axial direction.

At the same time, the high-pressure refrigerant may be introduced to the inner space of the casing 110 through the second back pressure hole 172*b*. The high-pressure refrigerant circulates the inner space of the casing 110 through a gas passing hole 161*a* provided at the first axial supporting plates 161, thereby cooling the inner space of the casing 110. This may effectively attenuate an overheating generated when a load of the drive unit 120 is increased, thereby enhancing a performance of the turbo compressor.

As the back pressure space is additionally formed on the rear surface of the impeller and the high-pressure refrigerant is supplied to the back pressure space, even if the impeller has an increased thrust as the drive unit is rotated at a high speed, the impeller may be effectively prevented from being pushed backward by the thrust. Further, as the thrust of the impeller is attenuated or reduced by a back pressure of the back pressure space, a load of the thrust bearing may be reduced. This may reduce an area of the thrust bearing, thereby allowing the turbo compressor to have an enhanced efficiency and a small size.

Furthermore, a refrigerant bypassed to the back pressure space may be partially introduced to the inner space of the casing, thereby cooling the drive unit installed at the inner space of the casing. With such a configuration, even if the amount of heat generated from the drive unit when the turbo compressor is operated at a high speed is significantly increased, the heat may be effectively cooled without an additional cooling device. This may allow the turbo compressor to have a small size, and may reduce the fabrication costs.

Another embodiment of the turbo compressor will be explained hereinafter. In the aforementioned embodiment, the valve space is formed in the front frame which constitutes a part of the casing, and the back pressure control valve is installed at the valve space. However, in this embodiment, the back pressure passage and the back pressure control valve are provided outside the casing.

Figure 9:
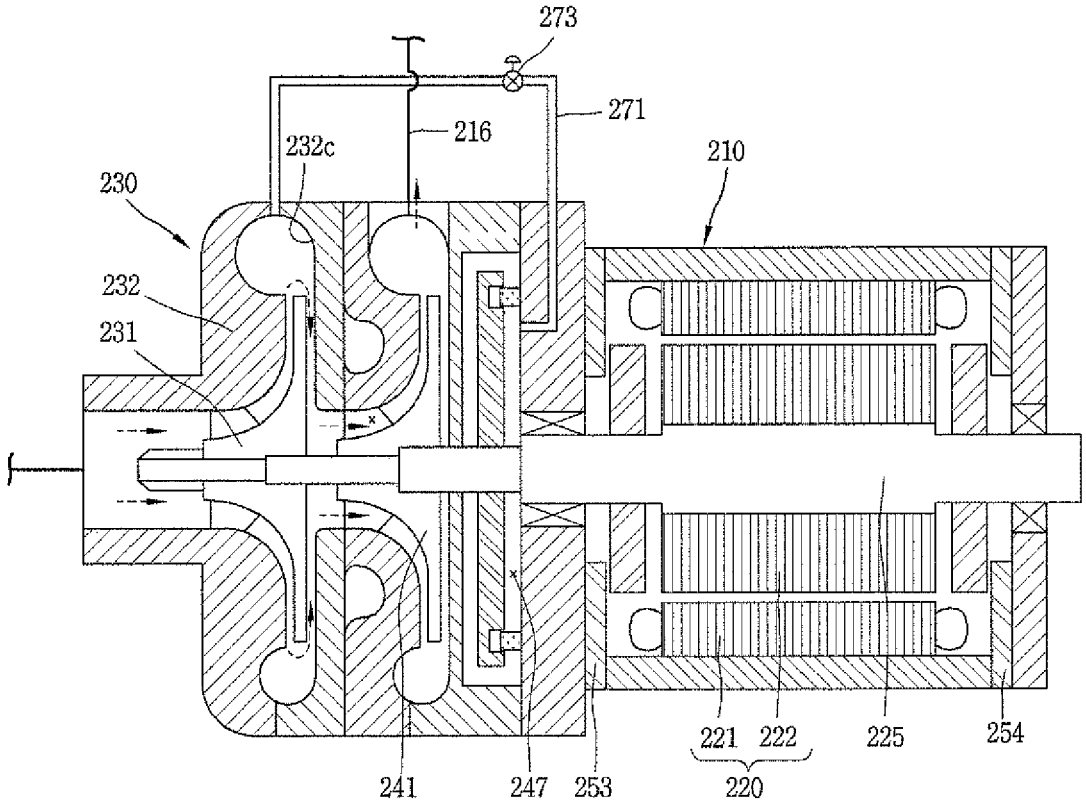
FIG. 9 is a cross-sectional view of a back pressure device in the turbo compressor according to another embodiment.

FIG. 9 is a cross-sectional view of a back pressure device in the turbo compressor according to another embodiment. As shown, one or a first end of a back pressure pipe 271 may be connected to a first outlet 232*c* of a first impeller housing 232. Another or a second end of the back pressure pipe 271 may be connected to a back pressure space 247 provided on or at a rear surface of a second impeller 241, by penetrating a casing 210 inward.

A back pressure control valve 273 may be installed at a middle region of the back pressure pipe 271, outside the casing 210. The back pressure control valve 273 may be formed as a solenoid valve opened and closed by an electric signal. However, the back pressure control valve 273 may have an open degree thereof controlled by an electric signal.

The back pressure control valve 273 of the turbo compressor according to this embodiment may be electrically connected to a controller (not shown) that controls a drive unit or drive 220, and may be controlled by the controller so as to be interworked with the drive unit 220 according to a rotational speed of the drive unit 220. For example, if a rotational speed of the drive unit 220 is lower than a preset or predetermined speed, the back pressure control valve 273 may maintain a closed state.

A rotary shaft 225 and first and second impellers 231, 241 prevent a thrust in the axial direction only by first and second thrust bearings 253, 254. However, in this case, as the rotational speed of the drive unit 220 is not high, a refrigerant suctioned into inlets of the first and second impellers 231, 241 does not have a high pressure. Accordingly, even if the first and second thrust bearings 253, 254 have a small area, a thrust may be sufficiently prevented.

On the other hand, if the rotational speed of the drive unit 220 is higher than the preset speed, the back pressure control valve 273 may be converted into an open state. As a result, the refrigerant compressed in a single stage by the first impeller 231, may partially move to the back pressure space 247, through the back pressure pipe 271 installed additionally.

Then, a back pressure of the back pressure space 247 may be increased, and prevent the rotary shaft 225 and the second impeller 241 from being pushed backward, together with the first and second thrust bearings 253, 254. As a result, even if the first and second thrust bearings 253, 254 have a small area, the rotary shaft 225 and the second impeller 241 may be stably supported.

Therefore, embodiments disclosed herein provide a turbo compressor capable of enhancing a compression efficiency by reducing a length of a pipe or a fluid passage for connecting a plurality of impellers to each other. Embodiments disclosed herein also provide a turbo compressor capable of preventing a collision of impellers by reducing a thrust, in a case of sequentially installing a plurality of impellers at one side of a rotor.

Embodiments disclosed herein further provide a turbo compressor capable of preventing an overheating by cooling a drive unit, in a case of sequentially installing a plurality of impellers at one side of a rotor. Embodiments disclosed herein additionally provide a turbo compressor capable of having an entirely small size by reducing a size of a thrust bearing, in a case of sequentially installing a plurality of impellers at one side of a rotor.

There may be provided a turbo compressor capable of attenuating a thrust of an impeller by a back pressure of a back pressure space, by forming the back pressure space on a rear surface of the impeller. If the impeller is installed in multi stages, a refrigerant compressed in a single stage by the front impeller may be supplied to a rear surface of the rear impeller to attenuate a thrust of the rear impeller. The high-pressure refrigerant compressed by the impellers may be guided to an inner space of a casing to radiate the inner space of the casing.

Embodiments disclosed herein provide a turbo compressor that may include an impeller housing having an impeller accommodation space, having an inlet formed at one or a first side of the impeller accommodation space, and having an outlet formed at another or a second side of the impeller accommodation space that communicates with the inlet; an impeller accommodated in the impeller accommodation space of the impeller housing, rotated together with a rotary shaft by being coupled to the rotary shaft, and configured to centrifugally-compress a fluid suctioned through the inlet of the impeller housing, and to discharge the compressed fluid to outside of the impeller housing through the outlet; a back pressure space formed between a rear surface of the impeller and the impeller housing; a back pressure passage connected between the outlet of the impeller housing and the back pressure space; and a back pressure control valve installed between the back pressure passage and the back pressure space, and configured to selectively open and close a region therebetween. The back pressure control valve may be selectively opened and closed by a pressure of the fluid discharged from the impeller housing.

The impeller may include a first impeller configured to compress a fluid in a single stage, and a second impeller configured to compress the single-stage compressed fluid in two stages. The back pressure space may be provided on a rear surface of the second impeller, and the back pressure passage may be configured to connect the outlet of the impeller housing that accommodates the first impeller or the second impeller therein, with the back pressure space.

Embodiments disclosed herein provide a turbo compressor that may include a casing; a drive unit or drive provided at an inner space of the casing, and configured to generate a rotational force; a rotary shaft provided to penetrate the casing, and configured to transfer the rotational force generated from the drive unit to outside; a compression unit provided outside the casing, and configured to compress a fluid together with an impeller, a back pressure space provided between the compression unit and the casing; a first back pressure passage configured to connect an outlet of the compression unit with the back pressure space; and a back pressure control valve configured to selectively open and close a region between the first back pressure passage and the back pressure space. The turbo compressor may further include a second back pressure passage configured to connect the outlet of the compression unit with the inner space of the casing.

The second back pressure passage may be diverged from a middle region of the first back pressure passage. The back pressure control valve may be installed at a position where the second back pressure passage is diverged from the first back pressure passage, and be configured to selectively open and close the first back pressure passage or the second back pressure passage, according to a pressure of the fluid discharged from the compression unit.

The back pressure control valve may have a first position where both of the first and second back pressure passages are closed, a second position where the first back pressure passage is open but the second back pressure passage is closed, and a third position where both of the first and second back pressure passages are open. A valve space where the first and second back pressure passages communicate with each other may be formed at a wall body of the casing. A first back pressure hole which forms the first back pressure passage, and a second back pressure hole which forms the second back pressure passage may be formed at the valve space, respectively. The first and second back pressure holes may be formed to have a predetermined interval therebetween, in a lengthwise direction of the valve space.

The back pressure control valve may include a valve body formed to move in the valve space according to a pressure of the fluid discharged from the compression unit, and disposed at a first position to close both of the first and second back pressure holes by being disposed at an outer side than the first back pressure hole, a second position to open the first back pressure hole and to close the second back pressure hole by being disposed between the first and second back pressure holes, or a third position to open both of the first and second back pressure holes by moving to an inner side than the second back pressure hole; and an elastic body configured to elastically support the valve body, and to provide an elastic force in an opposite direction to a pressure direction of the fluid discharged from the compression unit. The first back pressure passage may be formed to penetrate the casing inward, and the back pressure control valve may be installed outside the casing.

The back pressure control valve may be selectively open and closed according to a pressure of the fluid discharged from the compression unit. The back pressure control valve may be formed as a solenoid valve open and closed by an electric signal.

The impeller may include a first impeller configured to compress a fluid by a single stage, and a second impeller configured to compress the single-stage compressed fluid in two stages. A back pressure plate may be provided to face a rear surface of the second impeller. A sealing member or seal may be provided between the back pressure plate and the casing, such that an inner space of the sealing member may form the back pressure space.

First and second axial supporting plates may be fixed to both sides of the rotary shaft in a state that the drive unit is interposed therebetween. A thrust bearing may be provided on at least one of one or a first side surface of the first axial supporting plate, and one or a first side surface of the casing which faces the one side surface of the first axial supporting plate in the axial direction, and a thrust bearing may be provided on at least one of one or a first side surface of the second axial supporting plate, and another or a second side surface of the casing which faces the one side surface of the second axial supporting plate in the axial direction. The first and second axial supporting plates may be balance weights provided in a spaced manner from the drive unit.

The turbo compressor according to embodiment may have at least the following advantages.

As the back pressure space is additionally formed on the rear surface of the impeller and the high-pressure refrigerant is supplied to the back pressure space, even if the impeller has an increased thrust as the drive unit is rotated at a high speed, the impeller may be effectively prevented from being pushed backward by the thrust. Further, as the thrust of the impeller is attenuated or reduced by a back pressure of the back pressure space, a load of the thrust bearing may be reduced. This may reduce an area of the thrust bearing, thereby allowing the turbo compressor to have an enhanced efficiency and a small size.

Furthermore, a refrigerant bypassed to the back pressure space may be partially introduced to the inner space of the casing, thereby cooling the drive unit installed at the inner space of the casing. With such a configuration, even if the amount of heat generated from the drive unit when the turbo compressor is operated at a high speed is significantly increased, the heat may be effectively cooled without an additional cooling device. This may allow the turbo compressor to have a small size, and may reduce fabrication costs.

Further scope of applicability will become more apparent from the detailed description given hereinafter. However, it should be understood that the detailed description and specific examples, while indicating embodiments, are given by way of illustration only, since various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A turbo compressor, comprising:

a casing;

a drive provided at an inner space of the casing, and configured to generate a rotational force;

a rotary shaft provided to penetrate the casing, and configured to transfer the rotational force generated from the drive to an outside;

a compression unit provided outside of the casing, and configured to compress a fluid together with an impeller;

a back pressure space provided between the compression unit and the casing;

a first back pressure passage configured to connect an outlet of the compression unit with the back pressure space;

a back pressure control valve configured to selectively open and close a region between the first back pressure passage and the back pressure space; and a second back pressure passage configured to connect the outlet of the compression unit with an inner space of the casing.

2. The turbo compressor of claim 1, wherein the second back pressure passage is diverged from a middle region of the first back pressure passage, and wherein the back pressure control valve is installed at a position where the second back pressure passage is diverged from the first back pressure passage, and is configured to selectively open and close the first back pressure passage or the second back pressure passage, according to a pressure of the fluid discharged from the compression unit.

3. The turbo compressor of claim 2, wherein the back pressure control valve has a first position where both of the first and second back pressure passages are closed, a second position where the first back pressure passage is open but the second back pressure passage is closed, and a third position where both of the first and second back pressure passages are open.

4. The turbo compressor of claim 1, wherein a valve space where the first and second back pressure passages communicate with each other is formed at a wall body of the casing, wherein a first back pressure hole which forms the first back pressure passage, and a second back pressure hole which forms the second back pressure passage are formed at the valve space, respectively, and wherein the first and second back pressure holes are formed to have a predetermined interval therebetween, in a lengthwise direction of the valve space.

5. The turbo compressor of claim 4, wherein the back pressure control valve includes:

a valve body formed to move in the valve space according to a pressure of the fluid discharged from the compression unit, and disposed at a first position to close both of the first and second back pressure holes by being disposed at an outer side than the first back pressure hole, a second position to open the first back pressure hole and to close the second back pressure hole by being disposed between the first and second back pressure holes, or a third position to open both of the first and second back pressure holes by moving to an inner side than the second back pressure hole; and an elastic body configured to elastically support the valve body, and to provide an elastic force in an opposite direction to a pressure direction of the fluid discharged from the compression unit.

6. The turbo compressor of claim 1, wherein the first back pressure passage is formed to penetrate the casing inward, and wherein the back pressure control valve is installed outside the casing.

7. The turbo compressor of claim 6, wherein the back pressure control valve is selectively opened and closed according to a pressure of the fluid discharged from the compression unit.

8. The turbo compressor of claim 6, wherein the back pressure control valve is formed as a solenoid valve open and closed by an electric signal.

9. The turbo compressor of claim 1, wherein the impeller includes:

a first impeller configured to compress a fluid by a single stage; and a second impeller configured to compress the single-stage compressed fluid in two stages, wherein a back pressure plate is provided to face a rear surface of the second impeller, and wherein a seal is provided between the back pressure plate and the casing, such that an inner space of the seal forms the back pressure space.

10. The turbo compressor of claim 1, wherein first and second axial supporting plates are fixed to both sides of the rotary shaft in a state in which the drive is interposed therebetween, and wherein a thrust bearing is provided on at least one of a first side surface of the first axial supporting plate or a first side surface of the casing which faces the first side surface of the first axial supporting plate in an axial direction, and a thrust bearing is provided on at least one of a first side surface of the second axial supporting plate or a second side surface of the casing which faces the first side surface of the second axial supporting plate in the axial direction.

11. The turbo compressor of claim 10, wherein the first and second axial supporting plates are balance weights provided in a spaced manner from the drive.

12. A turbo compressor, comprising:

a casing;

a drive provided at an inner space of the casing, and configured to generate a rotational force;

a rotary shaft provided to penetrate the casing, and configured to transfer the rotational force generated from the drive to outside;

a first impeller and a first housing configured to compress a fluid in a single stage;

a second impeller and a second housing configured to compress the single-stage compressed fluid in two stages;

a back pressure space provided between the second housing and the casing;

a first back pressure passage configured to connect an outlet of the second impeller housing with the back pressure space;

a second back pressure passage configured to connect an outlet of the second impeller housing with the inner space of the casing; and a back pressure control valve configured to selectively open and close a region between the first back pressure passage and the second back pressure passage.

13. The turbo compressor of claim 12, wherein the back pressure control valve has a first position where both of the first and second back pressure passages are closed, a second position where the first back pressure passage is open but the second back pressure passage is closed, and a third position where both of the first and second back pressure passages are open.

14. The turbo compressor of claim 13, wherein a valve space where the first and second back pressure passages communicate with each other is formed at a wall body of the casing, wherein a first back pressure hole which forms the first back pressure passage, and a second back pressure hole which forms the second back pressure passage are formed at the valve space, respectively, and wherein the first and second back pressure holes are formed to have a predetermined interval therebetween, in a lengthwise direction of the valve space.

15. The turbo compressor of claim 14, wherein the back pressure control valve includes:

a valve body formed to move in the valve space according to a pressure of the fluid discharged from the second housing, and disposed at a first position to close both of the first and second back pressure holes by being disposed at an outer side than the first back pressure hole, a second position to open the first back pressure hole and to close the second back pressure hole by being disposed between the first and second back pressure holes, or a third position to open both of the first and second back pressure holes by moving to an inner side than the second back pressure hole; and an elastic body configured to elastically support the valve body, and to provide an elastic force in an opposite direction to a pressure direction of the fluid discharged from the second housing.

16. The turbo compressor of claim 12, wherein first and second axial supporting plates are fixed to both sides of the rotary shaft in a state in which the drive is interposed therebetween, and wherein a thrust bearing is provided on at least one of a first side surface of the first axial supporting plate or a first side surface of the casing which faces the first side surface of the first axial supporting plate in an axial direction, and a thrust bearing is provided on at least one of a first side surface of the second axial supporting plate or a second side surface of the casing which faces the first side surface of the second axial supporting plate in the axial direction.

17. A turbo compressor, comprising:

a casing;

a drive provided at an inner space of the casing, and configured to generate a rotational force;

a rotary shaft provided to penetrate the casing, and configured to transfer the rotational force generated from the drive to an outside;

a compression unit provided outside of the casing, and configured to compress a fluid together with an impeller;

a back pressure space provided between the compression unit and the casing;

a first back pressure passage configured to connect an outlet of the compression unit with the back pressure space; and a back pressure control valve configured to selectively open and close a region between the first back pressure passage and the back pressure space, wherein first and second axial supporting plates are fixed to both sides of the rotary shaft in a state in which the drive is interposed therebetween, and wherein thrust bearings are provided on at least a first of one side surface of the first axial supporting plate or a first side surface of the casing which faces the first side surface of the first axial supporting plate in an axial direction, and a thrust bearing is provided on at least one of a first side surface of the second axial supporting plate or a second side surface of the casing which faces the first side surface of the second axial supporting plate in the axial direction.

18. The turbo compressor of claim 17, wherein the first and second axial supporting plates are balance weights provided in a spaced manner from the drive.

* * * * *